United States Patent [19]

Pelrine et al.

[11] 4,299,594

[45] Nov. 10, 1981

[54] PROCESS FOR UTILIZING WASTE LUBRICATING OILS

[75] Inventors: Bruce P. Pelrine, Trenton, N.J.; Dennis E. Walsh, Richboro, Pa.

[73] Assignee: Mobil Oil Corporation, New York, N.Y.

[21] Appl. No.: 130,928

[22] Filed: Mar. 17, 1980

[51] Int. Cl.[3] ..... C10L 1/00; C10L 1/04

[52] U.S. Cl. ..... 44/50; 208/15; 585/14

[58] Field of Search ..... 208/15, 19, 179; 44/50, 44/51, 58; 585/14

[56] References Cited

U.S. PATENT DOCUMENTS

| | | | |
|---|---|---|---|
| 1,597,292 | 8/1926 | Rudigier | 208/15 |
| 2,048,371 | 7/1936 | Calderwood | 208/15 |
| 3,554,713 | 1/1971 | Bassett | 208/15 |

FOREIGN PATENT DOCUMENTS

| | | | |
|---|---|---|---|
| 2023646 | 1/1980 | United Kingdom | 44/50 |

*Primary Examiner*—T. M. Tufariello

*Attorney, Agent, or Firm*—Charles A. Huggett; Michael G. Gilman; James D. Tierney

[57] ABSTRACT

A process is provided wherein waste hydrocarbon oils are blended with resids and visbroken resids thereby eliminating the use of more valuable cutting stock.

6 Claims, 2 Drawing Figures

PROCESS FOR UTILIZING WASTE LUBRICATING OILS

BACKGROUND OF THE INVENTION

1. Field of the Invention

This invention is directed to a process of utilizing waste hydrocarbon oils, e.g., automotive engine oils, in which waste oil is blended with resids and visbroken resids to provide useful oils of lower viscosity.

2. Description of Prior Art

A federal energy administration waste oil fact sheet (June, 1976) showed estimated data for 1972 that $\sim 1.1 \times {}^{9}$ gallons of waste oil were generated. At a 4% increase in waste oil generation each year, by 1980 $1.5 \times 10^9$ gallons will be available. By blending waste oils with resids or visbroken resids, they may be used as low viscosity, pumpable fuels, thereby conserving valuable refinery streams such as kerosine and gas oil which would otherwise have to be employed as cutter stocks. Also using such waste oils as diluents is one method of upgrading the substantial quantities of resids obtained from the visbreaking of heavey oils.

SUMMARY OF THE INVENTION

The present invention is concerned with the use of waste oil as a viscosity cutter stock. For example, one requirement which a heavy fuel oil must meet is that of viscosity; a maximum viscosity of about 860 cs @40° C. is specified for No. 6 fuel. By blending a waste automotive oil with an Arab light resid (>750° F. IBP), the viscosity of the resid can be reduced from about 43,000 cs to an acceptable level. As previously mentioned waste oils may be blended with resids which have undergone a visbreaking process. Visbreaking provides heavy fuel oils having much lower viscosities than their initial values though usually still not meeting the viscosity specifications. Thus cutter stock addition to the visbroken product is necessary. The cutter stock is supplied from other refinery streams and is of greater value than the heavy fuel oil product of which it becomes a part. The use of waste oils as cutter stocks could eliminate or minimize refinery stream cutter requirements. Substantially less waste oil is required as cutter stock for visbroken resids than for raw resids.

DESCRIPTION OF SPECIFIC EMBODIMENTS

Any used oil mineral, synthetic or mixed mineral and synthetic oil blends are useful in this invention. Automotive engine crankcase oils provide an excellent source of used oil. Other types of used oils such as hydraulic oils, circulating oils, transmission oils, turbine oils and the like are also highly useful. The waste oils may be blended under any suitable conditions, preferably ambient, until the desired viscosity is obtained. Any blending technique known to the art may be used to accomplish the blending.

The following Table shows the various blends of waste oil in a typical resid (Arab light >750° F IBP) and its effect on the overall viscosity. The initial viscosity of the resid is ~43,000 cs at 40° C. Analyses of both the Arab light resid and the waste oil are shown below:

TABLE

| Component | Resid | Waste Oil |
|---|---|---|
| Lead | <0.01% | 0.36% |
| Sulfur | 3.41% | 0.33% |
| Nickel | 14 ppm | 1.1 ppm |
| Vanadium | 54 ppm | 1.5 ppm |
| Carbon | | 84.8% |
| Hydrogen | | 13.21% |
| Nitrogen | | 0.14% |
| Oxygen | | 1.2% |

| Blend (% Oil in Resid) | KV, 40° C. |
|---|---|
| 0 | 43,000 |
| 10 | — |
| 15 | 7,010 |
| 20 | 4,326 |
| 30 | — |
| 40 | 999 |
| 50 | 547 |
| 100 | — |

Figure 1:
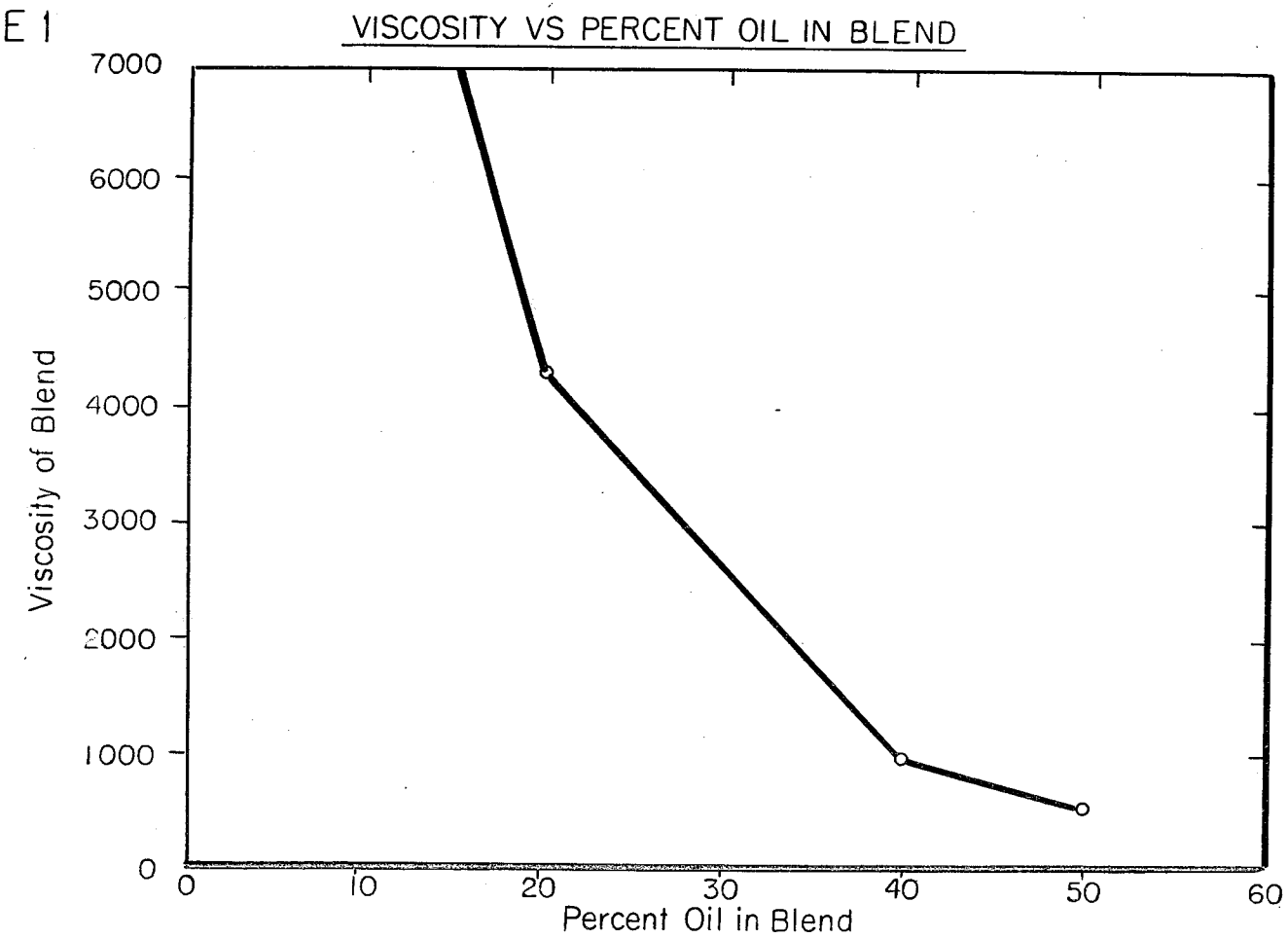
Figure 2:
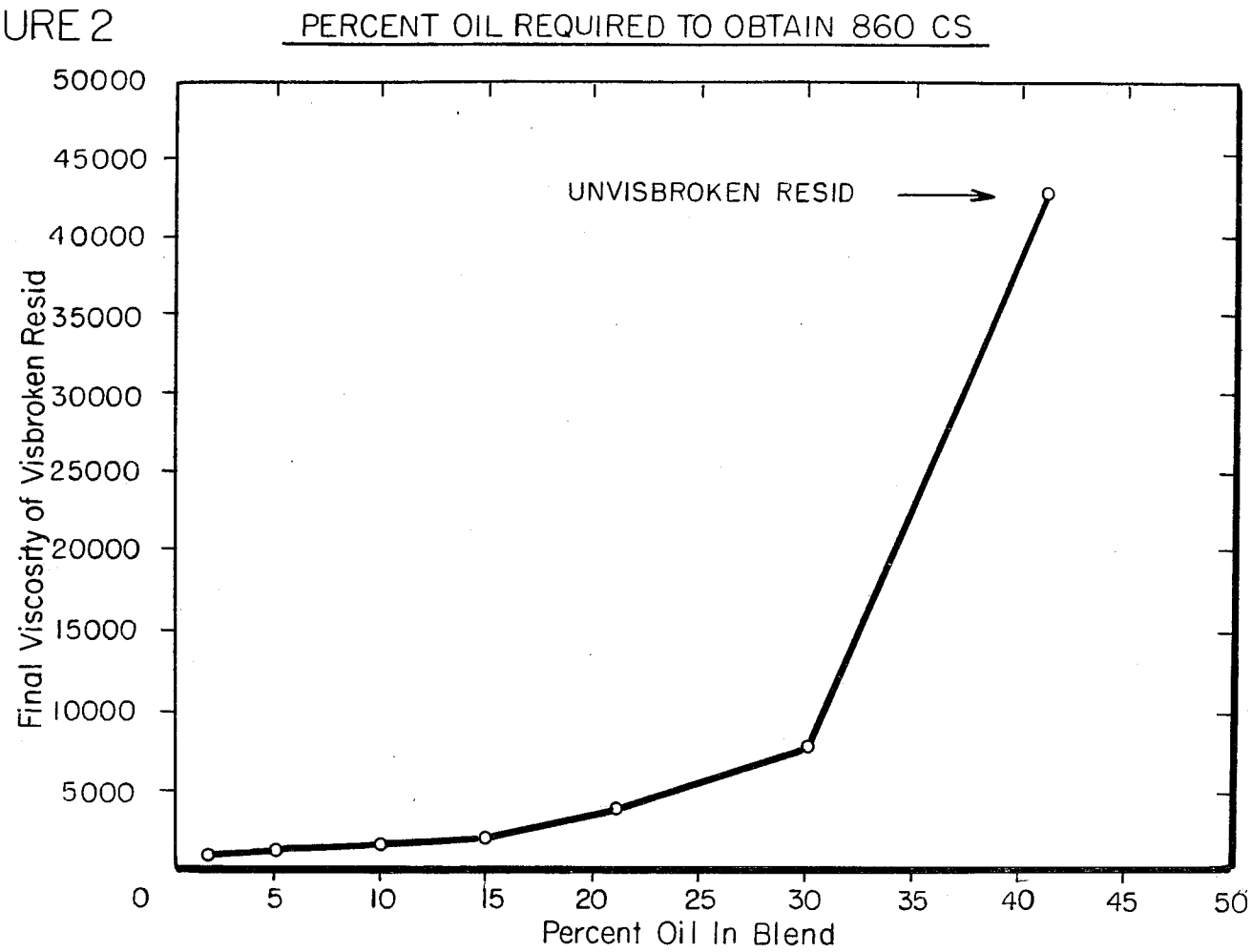

These data, plotted as viscosity vs. % waste oil in the blend, yield the attached FIG. 1. This figure shows that to obtain a blend viscosity of 860 cs @ 40° C., at least 41% waste oil must be used. Also attached is FIG. 2 which shows the wt. % waste oil required to reduce the viscosity of a visbroken resid. The data points are for resid visbroken to different final viscosities (i.e., visbroken at various severities). The target, blended viscosity is 860 cs @ 40° C. Thus for a typical visbroken resid viscosity of 4,000cs @ 40°C., only ~ 21% waste oil would be required to meet specification.

It is noted that the lead content of the waste oil may prove to be a possible pollutant when blended with a resid. Yet techniques are known which remove such contaminants from waste oils. On the other hand, indications are strong that a move away from using lead as an antiknock agent in gasoline is forthcoming. This would result in very low, or no, lead concentration in waste oils removed from vehicles burning low lead or unleaded fuels and obviate any lead pollution problem. Thus the presence of potential metal pollutants in general in the waste oil is not viewed as a problem for today's advancing technology.

The invention in its broader aspects is not limited to the exemplary details described herein and departures therefrom may be made within the scope of the invention without diminishing its advantages.

What is claimed is:

1. A process for reclaiming waste hydrocarbon oils of lubricating viscosity comprising blending used or waste oil of lubricating viscosity with a suitable resid or visbroken resid until an oil with a viscosity of less than about 43,000 centastokes is obtained.

2. The process of claim 1 in which the used oil is an automotive engine oil.

3. The process of claim 1 in which the resultant oil blend has the viscosity required for a heavy fuel oil.

4. The process of claim 1 in which said used or waste oil is blended with a visbroken resid.

5. The process of claim 4 where the amount of waste oil blended varies between 2–50%.

6. The process of claim 5 wherein the resultant blend is suitable for use as a fuel oil.

* * * * *